US005462474A

United States Patent [19]

Hansen

[11] Patent Number: 5,462,474

[45] Date of Patent: Oct. 31, 1995

[54] METHOD OF FACETTING A GEM

[75] Inventor: Erling Hansen, Tucson, Ariz.

[73] Assignee: Ronald W. Swager, Tucson, Ariz.

[21] Appl. No.: 248,393

[22] Filed: May 24, 1994

[51] Int. Cl.[6] ..... B24B 1/00

[52] U.S. Cl. ..... 451/41; 451/57; 125/30.01; 63/32

[58] Field of Search ..... 451/28, 41, 43, 451/57, 58, 54; 125/30.01; 63/32

[56] References Cited

U.S. PATENT DOCUMENTS

| | | | |
|---|---|---|---|
| 2,414,598 | 1/1947 | Klipper | 451/41 |
| 2,429,961 | 10/1947 | Rakowitzky | 451/45 |
| 3,534,510 | 10/1970 | Leibowitz | 451/41 |
| 3,585,764 | 6/1971 | Huisman et al. | 125/30.01 |
| 4,083,352 | 4/1978 | Andrychuk | 451/41 |
| 5,072,549 | 12/1991 | Johnston | 451/41 |
| 5,179,931 | 1/1993 | Leibowitz et al. | 451/41 |
| 5,293,858 | 3/1994 | Peters | 125/30.01 |

*Primary Examiner*—Maurina T. Rachuba
*Attorney, Agent, or Firm*—Ogram & Teplitz

[57] ABSTRACT

A method, and product from the method, of faceting a gemstone in which the facets, when combined with the polishing/non-polishing of the facet form an image such as the Star-of-David. The image is visible when viewed through the table of the gem. On one end of a clear or substantially clear gemstone, a series of facets are made which combine to create lines and boundaries. Through selective polishing of the facets, usually as they are made, some of the facets so created are darker and more visible than the others. These darker facets assist in forming the Star-of-David, or other image, visible through the table of the finished gemstone.

13 Claims, 7 Drawing Sheets

| FACET SET № | NUMBER OF FACETS | RANGE OF ANGLES | IDEAL ANGLE | INDEX VALUES |
|---|---|---|---|---|
| UPPER PORTION (PAVILLION)– | | | | |
| 1 | 24 | 90 | 90 | 2,6,10,14,18,22,26,30,34,38,42,46,50,54,58,62,66,70,74,78,82,86,90,94 |
| 2 | 6 | 30-60 | 40-50 | 8,24,40,56,72,88 |
| 3 | 12 | 9.5-10.5 LESS THAN #2 | 9.75 LESS THAN #2 | 4,12,20,28,36,44,52,60,68,76,84,92 |
| 4 | 6 | 4-6 LESS THAN #3 | 5.1 LESS THAN #3 | 16,32,48,64,80,96 |
| 5 | 6 | AT LEAST 0.5 LESS THAN #4 | AT LEAST 1 LESS THAN #4 | 16,32,48,64,80,96 |
| 6 | 6 | AT LEAST 0.5 LESS THAN #5 | AT LEAST 1 LESS THAN #5 | 16,32,48,64,80,96 |
| 7 | 12 | AT LEAST 3 MORE THAN #2 | AT LEAST 4 MORE THAN #2 | 6,10,22,26,38,42,54,58,70,74,86,90 |
| 8 | 12 | AT LEAST 0.5-4.5 MORE THAN #7 | AT LEAST 0.5-2.5 MORE THAN #7 | 2,14,18,30,34,46,50,62,66,78,82,94 |
| LOWER PORTION (CROWN)– | | | | |
| 9 | 12 | 20-40 | 20-40 | 2,14,18,30,34 46,50,62,66,78,82,94 |
| 10 | 12 | 3 MORE THAN #9 | 3 MORE THAN #9 | 6,10,22,26,38,42,54,58,70,74,86,90 |
| 11 | 1 | 0 (ZERO) | 0 (ZERO) | ANY INDEX |

FIG. 12

METHOD OF FACETTING A GEM

BACKGROUND

This invention relates generally to gemology and more particularly to the placement of facets so as to create an image.

Almost since the dawn of history, Man has been intrigued by various stones. Some stones have attributed to them mythical powers to heal, increase intelligence, assist in child delivery, and to cast spells. On a more practical side, gemstones have been used for centuries as a ready and portable source of wealth.

For some centuries at least, the knowledge of facetting of gemstones has been held and used to increase the luster and value of gemstones. As early as 1678, it was recorded that the Indians were cutting and polishing diamonds in this fashion.

Facetting of a stone is done to increase the luster associated with the gem. Light entering the stone is reflected by the facets and ideally emerges back out of the table, being the top flat portion of the gem. The internal reflection of light in a gem is increased through the use of polishing of the facet so that diffraction does not occur at the gem's stone/air interface.

Although faceting does increase the luster of the gem, it traditionally has done little else.

SUMMARY OF THE INVENTION

The invention is a method, and product from the method, of faceting a gemstone in which the facets, when combined with the polishing/non-polishing of the facets, form an image viewable through the table of the gem.

In the preferred embodiment, the Star-of-David is formed and is clearly visible when viewed through the table of the gem.

On one end of a clear or substantially clear gemstone, a series of facets are made which combine to create lines and boundaries. Through selective polishing of the facets, usually as they are made, some of the facets so created are darker and more visible than the others. These darker facets assist in forming the Star-of-David visible through the table of the finished gemstone.

In a similar manner, other forms and images are created through the use of parallel lines and selective facet polishing.

The invention, together with various embodiments thereof, will be more fully explained by the accompanying drawings and the following descriptions.

DRAWINGS IN BRIEF

FIGS. 1A, 1B, and 1C are top, side, and bottom views respectively of a gem showing the preferred embodiment's first set of facets.

FIGS. 2A, 2B, and 2C are top, side, and bottom views respectively of a gem showing the preferred embodiment's second set of facets.

FIGS. 3A, 3B, and 3C are top, side, and bottom views respectively of a gem showing the preferred embodiment's third set of facets.

FIGS. 4A, 4B, and 4C are top, side, and bottom views respectively of a gem showing the preferred embodiment's fourth set of facets.

FIGS. 5A, 5B, and 5C are top, side and bottom views respectively of a gem showing the preferred embodiment's fifth set of facets.

FIGS. 6A, 6B, and 6C are top, side, and bottom views respectively of a gem showing the preferred embodiment's sixth set of facets.

FIGS. 7A, 7B, and 7C are top, side, and bottom views respectively of a gem showing the preferred embodiment's seventh set of facets.

FIGS. 8A, 8B, and 8C are top, side, and bottom views respectively of a gem showing the preferred embodiment's eighth set of facets.

FIGS. 9A, 9B, and 9C are top, side, and bottom views respectively of a gem showing the preferred embodiment's ninth set of facets.

FIGS. 10A, 10B, and 10C are top, side, and bottom views respectively of a gem showing the preferred embodiment's tenth set of facets.

FIG. 12 is a table describing the parameters for the formation of the preferred embodiment.

DRAWINGS IN DETAIL

For ease of discussion, the pavillion portion of the stone is considered the upper portion while the crown is considered the lower portion. This is the representation of the figures.

Within this discussion, the apparatus used to create the facets contains ninety-six teeth, representing a 360 degree circle. Each tooth therefore represents 3.75 degrees of movement. For the embodiment represented by the following figures, the indexing of the faceting machine is represented by the tooth number itself. As example, if tooth number 8 is designated, this is equivalent to thirty degrees.

Those of ordinary skill in the art readily recognize other machines which can be used for this purpose and also recognize variations in the indexing.

Figure 1A:
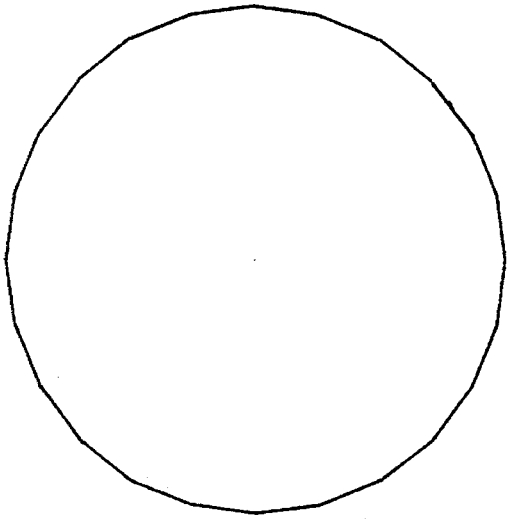
Figure 1B:
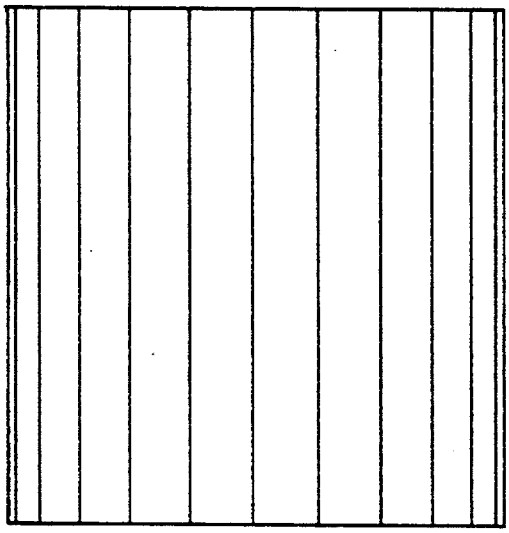
Figure 1C:
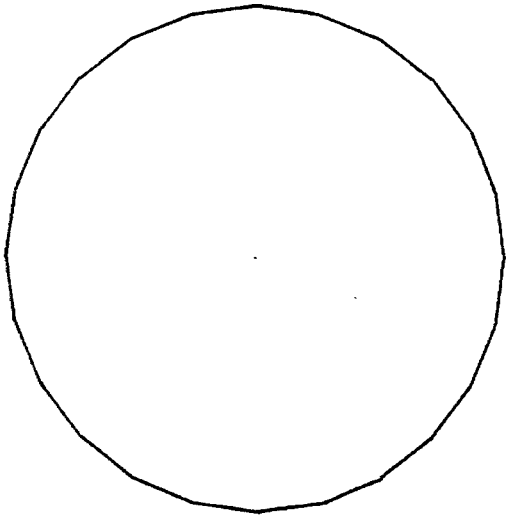

FIGS. 1A, 1B, and 1C are top, side, and bottom views respectively of a gem showing the preferred embodiment's first set of facets.

The first set of facets are used to create a generally "round" gemstone from which the upper and lower ends are created. In the preferred embodiment, twenty four girdle facets are made being substantially ninety degrees from a plane.

To create the first set's twenty four facets, the faceting tool is indexed at: 2, 6, 10, 14, 18, 22, 26, 30, 34, 38, 42, 46, 50, 54, 58, 62, 66, 70, 74, 78, 82, 86, 90, and 94.

Those of ordinary skill in the art readily recognize various other configurations to create this starting point, including the variations on the number of facets involved.

Figure 2A:
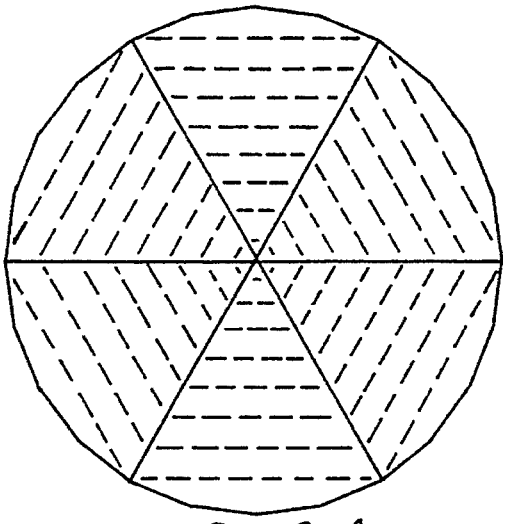
Figure 2B:
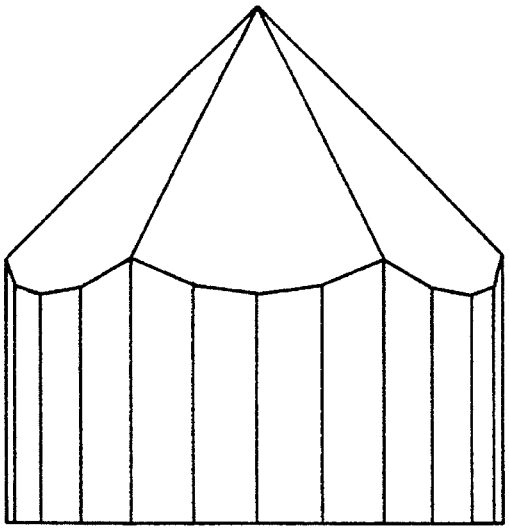
Figure 2C:
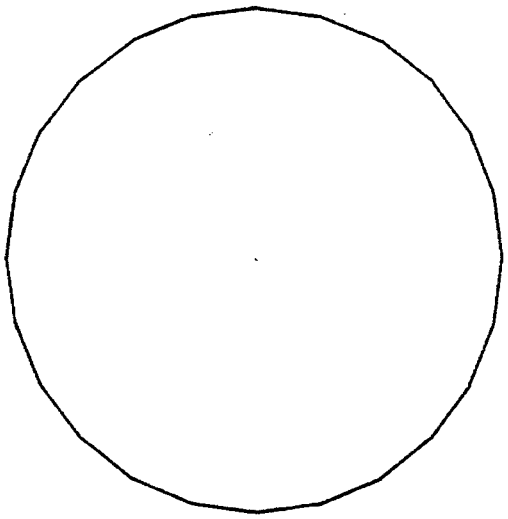

FIGS. 2A, 2B, and 2C are top, side, and bottom views respectively of a gem showing the preferred embodiment's second set of facets.

The second set of facets are six facets having an angle between thirty and sixty degrees. It has been found that the optimal angle lies between forth and fifty degrees though.

The index settings for the creation of this set of facets is: 8, 24, 40, 56, 72, and 88.

The second set of facets are not polished.

Figure 3A:
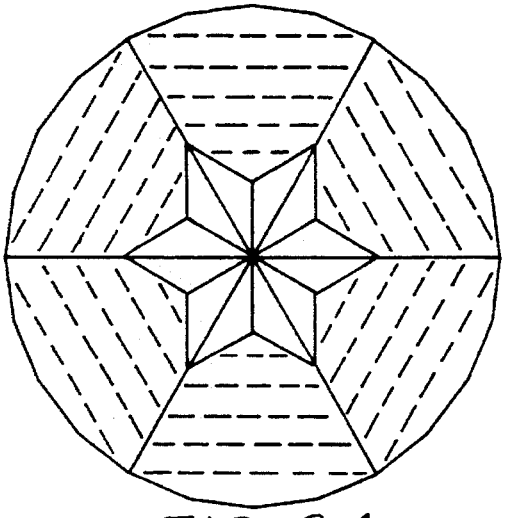
Figure 3B:
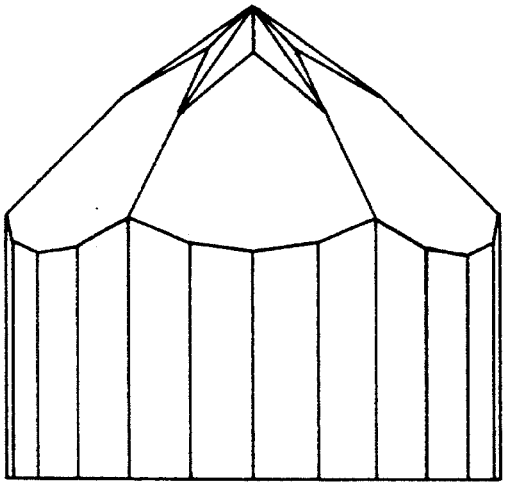
Figure 3C:
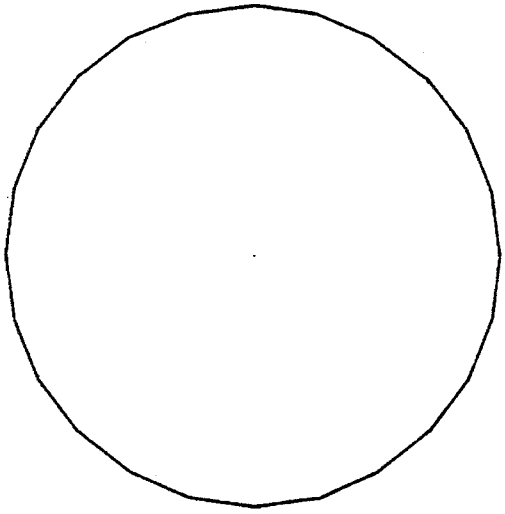

FIGS. 3A, 3B, and 3C are top, side, and bottom views respectively of a gem showing the preferred embodiment's third set of facets.

Twelve facets having angles being from 9 to 10.5 degrees less than the angle chosen for the second set of facets are created by indexing at: 4, 12, 20, 28, 36, 44, 52, 60, 68, 76, 84, and 92. These facets are polished.

In this embodiment, the formation of the Star-of-David, the third set of facets are used to create the outside boundaries of the star.

Figure 4A:
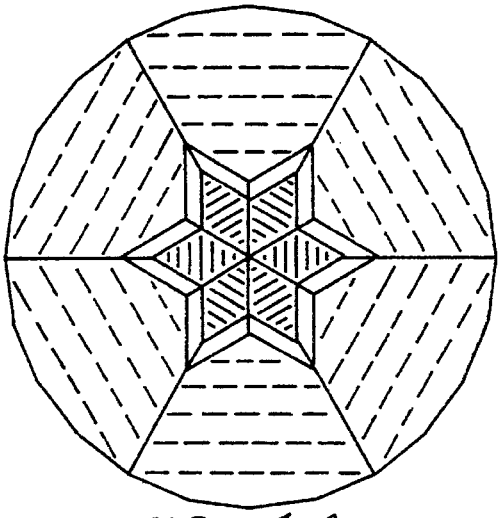
Figure 4B:
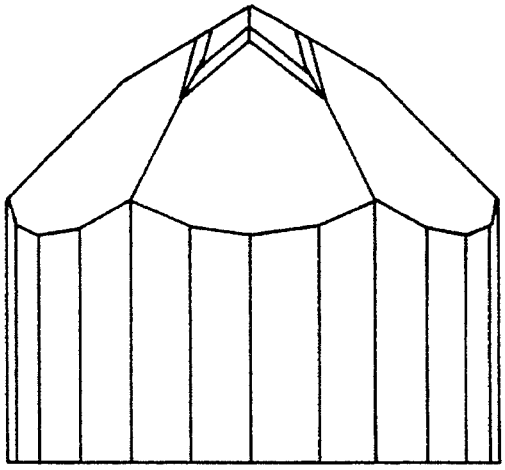
Figure 4C:
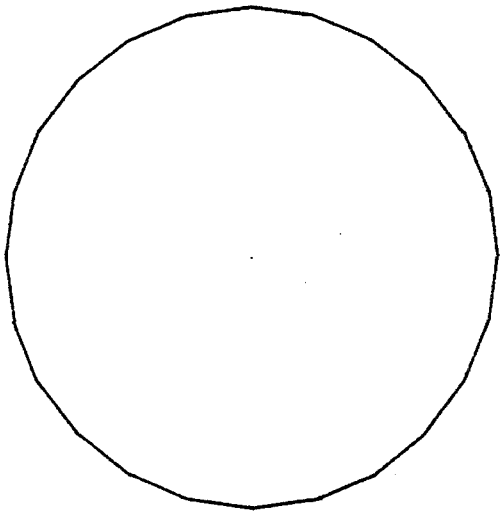

FIGS. 4A, 4B, and 4C are top, side, and bottom views respectively of a gem showing the preferred embodiment's fourth set of facets.

To create the bold (wide) outside lines of the Star-of-David, the fourth set of facts, six in number, have angles chosen to be 4 to 6 degrees less than the angle of the third set of facets. The optimal angle is 5.1 degrees.

To create these facets, indexing is set at 16, 32, 48, 64, 80, and 96.

The fourth set of facets are not polished so that the outside of the star is made more visible.

Figure 5A:
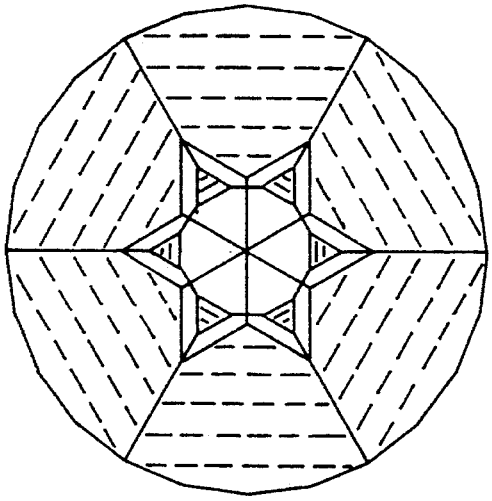
Figure 5B:
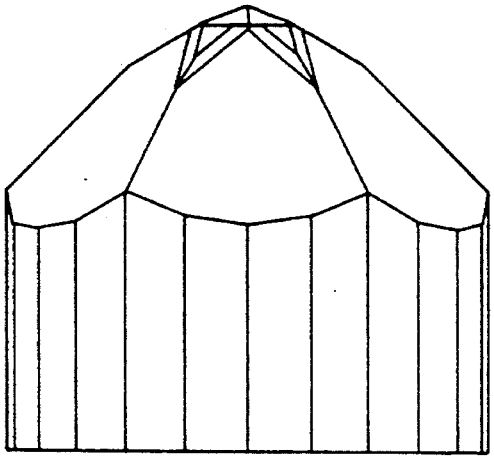
Figure 5C:
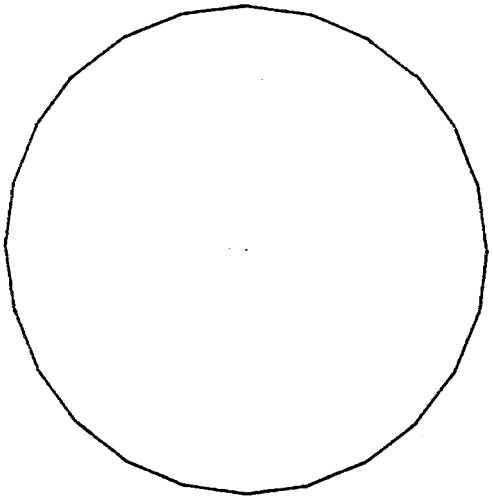

FIGS. 5A, 5B, and 5C are top, side, and bottom views respectively of a gem showing the preferred embodiment's fifth set of facets.

Six facets are formed having angles of between at least one-half a degree less than the angles of the fourth set of facets and indexed at 16, 32, 48, 64, 80, 96. These facets are polished.

It has been found that having an angle at least one degree less than the angle of the fourth set of facets produces the best optimal results.

This faceting creates one group of the inside lines of the star.

Figure 6A:
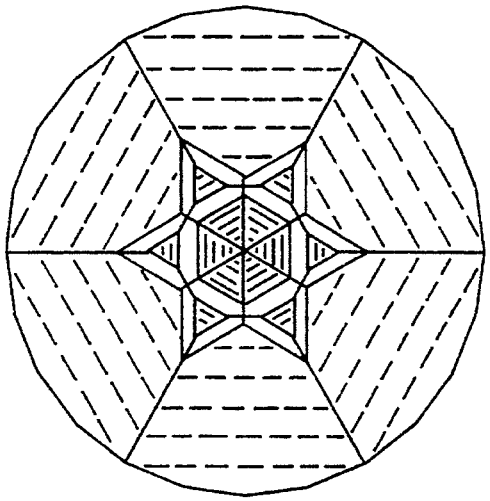
Figure 6B:
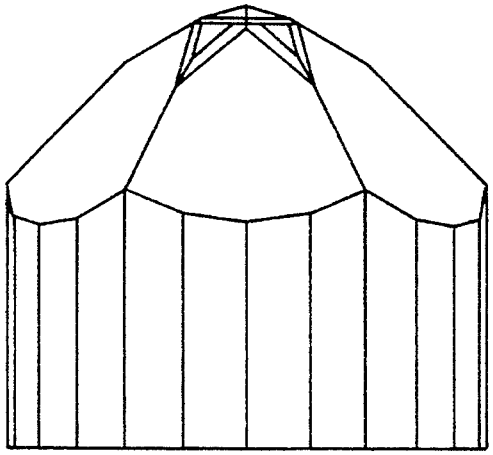
Figure 6C:
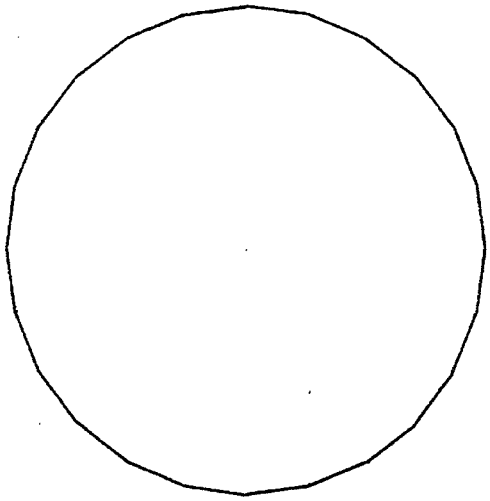

FIGS. 6A, 6B, and 6C are top, side, and bottom views respectively of a gem showing the preferred embodiment's sixth set of facets.

The other inside line of the star is formed by the formation of six facets having an angle at least one-half degree less than those of the fifth set of facets. Indexing at 16, 32, 48, 64, 80, and 96, accomplish this task.

An angle of at least one degree less than those of the fifth set of facets is optimal.

This set of facet is left without polishing so that the bold (wide) inside lines are more visible.

At this point, the entire Star-of-David has been formed and is clearly visible when the gem is viewed through the table of the gem (not formed as of this step).

The following facets are used to further highlight the image.

Figure 7A:
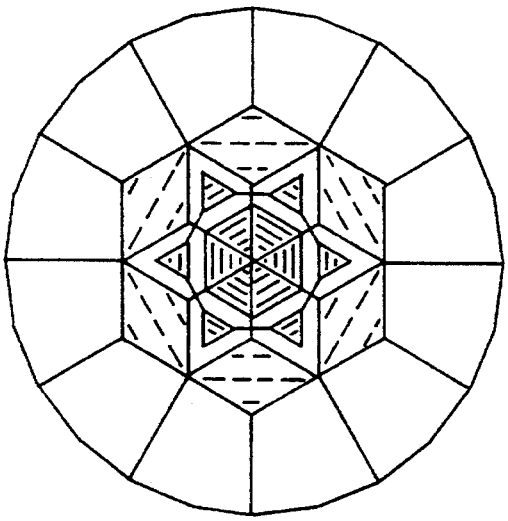
Figure 7B:
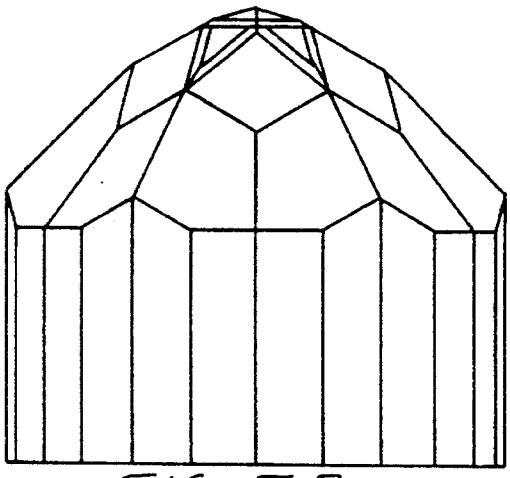
Figure 7C:
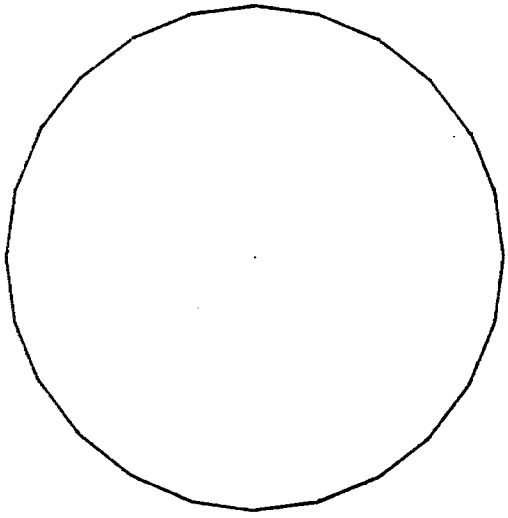

FIGS. 7A, 7B, and 7C are top, side, and bottom views respectively of a gem showing the preferred embodiment's seventh set of facets.

To bracket the image of the Star-of-David, twelve facets are formed having an angle at least three degrees more than the angles of the second set of facets. In practice, four degrees have shown to be optimal.

Indexing these twelve facets at: 6, 10, 22, 26, 38, 42, 54, 58, 70, 74, 86, and 90, accomplish this task.

These facets are polished to further the bracketing affect.

Figure 8A:
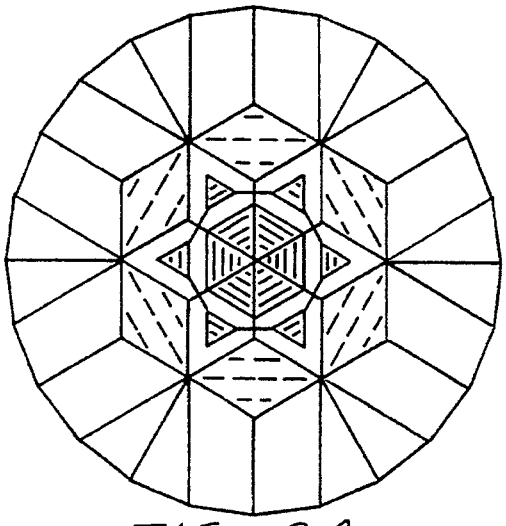
Figure 8B:
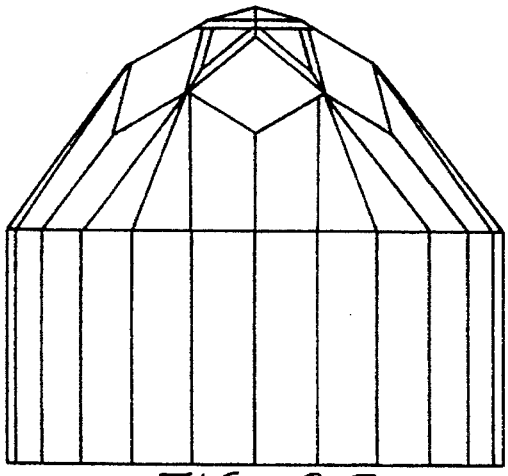
Figure 8C:
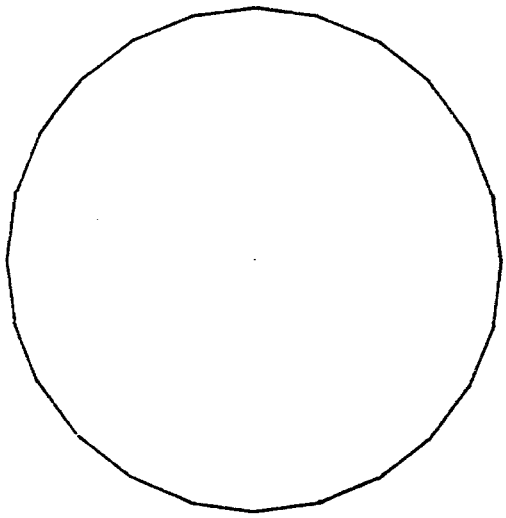

FIGS. 8A, 8B, and 8C are top, side, and bottom views respectively of a gem showing the preferred embodiment's eighth set of facets.

To increase the cosmetic appeal of the gem, the eighth set of facets are twelve facets having angles of between a half a degree to 4.5 degrees more than the angle of the seventh set and are indexed at: 2, 14, 18, 30, 34, 46, 50, 62, 66, 78, 82, and 94.

It has been found that the ideal angle is between a half of a degree and 2.5 degrees.

Usually, prior to the work beginning on the other end of the gem, it is rotated in the faceting machine and then the following facets are made.

Those of ordinary skill in the art readily recognize that various other methods to make the table on the other side of the gem. The following sets of facets represent the preferred embodiment.

Figure 9A:
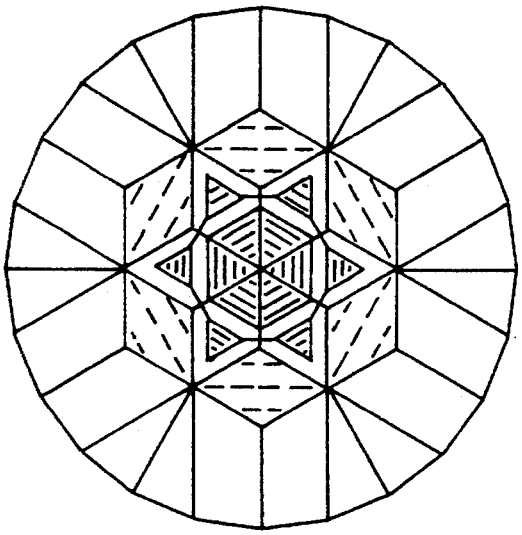
Figure 9B:
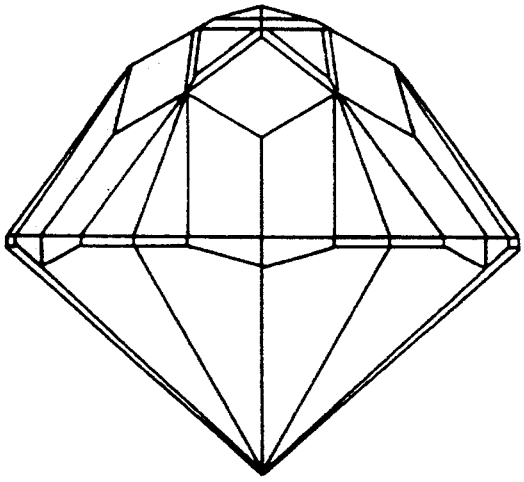
Figure 9C:
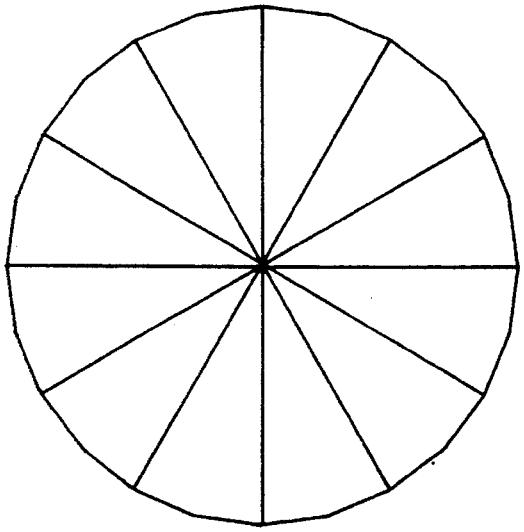

FIGS. 9A, 9B, and 9C are top, side, and bottom views respectively of a gem showing the preferred embodiment's ninth set of facets.

Twelve facets chosen between twenty and forty degrees are created at indexes of: 2, 14, 18, 30, 34, 46, 50, 62, 66, 78, 82, and 94. These facets are polished.

Figure 10A:
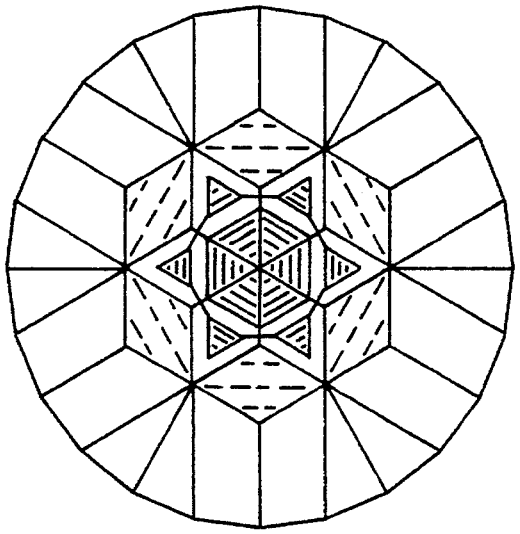
Figure 10B:
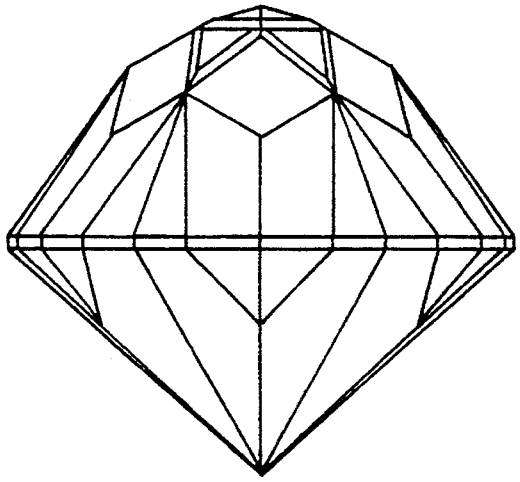
Figure 10C:
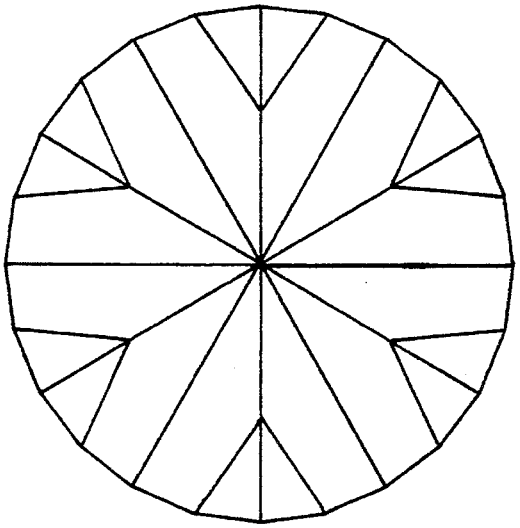

FIGS. 10A, 10B, and 10C are top, side, and bottom views respectively of a gem showing the preferred embodiment's tenth set of facets.

The tenth set of facets are twelve facets formed having an angle of three degrees less than the ninth set of facets. The index setting for these facets are: 6, 10, 22, 26, 38, 42, 58, 70, 74, 86, and 90.

Figure 11A:
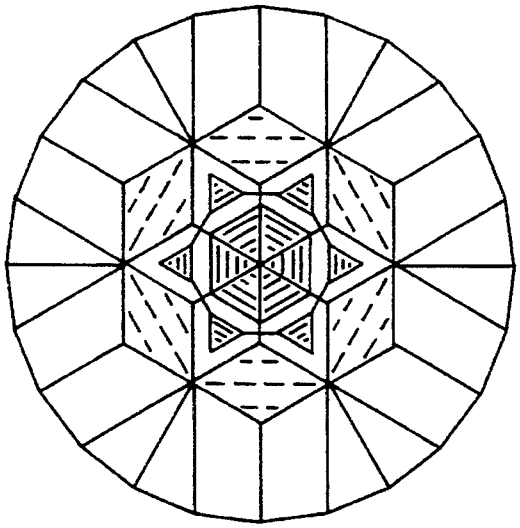
FIGS. 11A, 11B and 11C are top, side and bottom views respectively of a gem showing the preferred embodiment's eleventh set of facets.
Figure 11B:
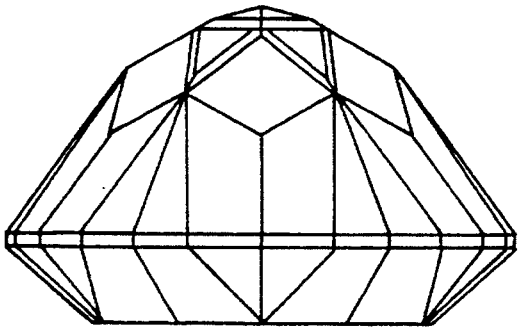
Figure 11C:
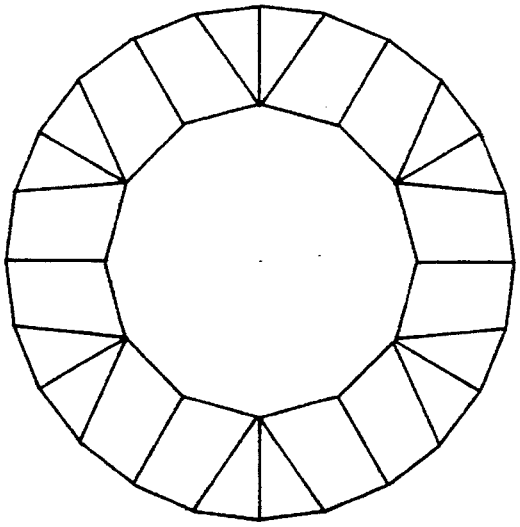

FIGS. 11A, 11B, and 11C are top, side, and bottom views respectively of a gem showing the preferred embodiment's eleventh set of facets.

The eleventh set of facets for the preferred embodiment is a single facet forming the table itself. This facet has any index value and has a zero degree setting.

Although the figures have shown how the Star-of-David is formed, those of ordinary skill in the art readily recognize that other figures and forms can be created using the same technique of forming parallel lines caused by facets and by not polishing the facet between the lines.

FIG. 12 is a table describing the parameters for the formation of the preferred embodiment.

This table summarizes the values described relative to FIGS. 1–11 for the formation of the Star-of-David. As noted before, the indexing values are each commensurate with 3.75 degrees.

It is clear from the foregoing that the present invention creates a highly unique facetted gemstone.

What is claimed is:

1. A method of faceting a gem comprising the steps of:

a) creating a first set of facets on the gem being twenty-four girdle facets having angle of substantially ninety degrees; and, b) on an upper portion of the gem,

1) creating a second set of facets being six facets in the range of thirty to sixty degrees,

2) creating a third set of facets being twelve facets having angles 9 to 10.5 degrees less than the angle of the second set of facets,

3) creating a fourth set of facets being six facets having angles 4 to 6 degrees less than the angles of the third set of facets,

4) creating a fifth set of facets being six facets having angles at least one-half degree less and than the angles of the fourth set of facets,

5) creating a sixth set of facets being six facets having angles at least one-half degree less than the angles of the fifth set of facets, 6) creating a seventh set of facets being twelve facets having angles at least three degrees more than the angles of the second set of facets, and, 7) creating an eighth set of facets being twelve facets having angles between 0.5 and 4.5 degrees more than the angle of the seventh set of facets.

2. The method of faceting a gem according to claim 1 further comprising the steps of, on a bottom portion of said gem:

a) creating a ninth set of facets being twelve facets having angles between twenty and forty degrees;

b) creating a tenth set of facets being twelve facets having angles at least three degrees more than the ninth set of facets; and, c) creating an eleventh set of facets being a single facet having an angle of zero degrees.

3. The method of faceting a gem according to claim 2 further comprising the steps of:

a) polishing the ninth set of facets;

b) polishing the tenth set of facets; and, c) polishing the eleventh set of facets.

4. The method of faceting a gem according to claim 1 further comprising the steps of:

a) polishing the first set of facets;

b) polishing the third set of facets;

c) polishing the fifth set of facets;

d) polishing the seventh set of facets; and, e) polishing the eighth set of facets.

5. The method of faceting a gem according to claim 4 wherein said third set of facets have angles 9.75 degrees less than the angles of the second set of facets.

6. The method of faceting a gem according to claim 5 wherein the fourth set of facets have angles 5.1 degrees less than the angles of the third set of facets.

7. A method of faceting a gem having a first set of facets on a first end thereof, the method comprising the steps of, at a second end of the gem:

a) creating a second set of facets being six facets in the range of thirty to sixty degrees;

b) creating a third set of facets being twelve facets having angles 9 to 10.5 degrees less than the angle of the second set of facets;

c) creating a fourth set of facets being six facets having angles 4 to 6 degrees less than the angles of the third set of facets;

d) creating a fifth set of facets being six facets having angles at least one-half degree less and than the angles of the fourth set of facets;

e) creating a sixth set of facets being six facets having angles at least one-half degree less than the angles of the fifth set of facets; and, f) creating a seventh set of facets being twelve facets having angles at least three degrees more than the angles of the second set of facets.

8. The method of faceting a gem according to claim 7 further including the steps of faceting an opposite end of said gem to create a table.

9. The method of faceting a gem according to claim 8 wherein the step of facetting an opposite end of said Gem includes the steps of:

a) creating a ninth set of facets being twelve facets having angles between twenty and forty degrees;

b) creating a tenth set of facets being twelve facets having angles at least three degrees more than the ninth set of facets; and, c) creating an eleventh set of facets being a single facet having an angle of zero degrees.

10. The method of faceting a gem according to claim 9 further comprising the steps of:

a) polishing the ninth set of facets;

b) polishing the tenth set of facets; and, c) polishing the eleventh set of facets.

11. The method of faceting a gem according to claim 7 further comprising the steps of:

a) polishing the first set of facets;

b) polishing the third set of facets;

c) polishing the fifth set of facets; and, d) polishing the seventh set of facets.

12. The method of faceting a gem according to claim 11 further including the steps of creating an eighth set of facets being twelve facets having angles between 0.5 and 4.5 degrees more than the angle of the seventh set of facets.

13. The method of faceting a gem according to claim 12 further including the step of polishing the eighth set of facets.

* * * * *